US010861288B2

(12) United States Patent
Davis

(10) Patent No.: US 10,861,288 B2
(45) **Date of Patent: *Dec. 8, 2020**

(54) CONTINUAL LIMIT HOLD'EM QUASI-TOURNAMENTS

(71) Applicant: BRAIN GAMES, L.C., Dallas, TX (US)

(72) Inventor: Malcolm B. Davis, Dallas, TX (US)

(73) Assignee: BRAIN GAMES, L.C., Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/599,999

(22) Filed: Oct. 11, 2019

(65) Prior Publication Data

US 2020/0043294 A1 Feb. 6, 2020

Related U.S. Application Data

(63) Continuation of application No. 14/269,923, filed on May 5, 2014, now Pat. No. 10,445,985, which is a continuation of application No. 12/855,582, filed on Aug. 12, 2010, now Pat. No. 8,715,051.

(60) Provisional application No. 61/233,366, filed on Aug. 12, 2009.

(51) Int. Cl.
*G07F 17/32* (2006.01)

(52) U.S. Cl.
CPC ..... *G07F 17/3276* (2013.01); *G07F 17/32* (2013.01); *G07F 17/3293* (2013.01)

(58) Field of Classification Search
CPC ... G07F 17/3276; G07F 17/32; G07F 17/3293
USPC ..... 463/13
See application file for complete search history.

(56) References Cited

U.S. PATENT DOCUMENTS

| | | | |
|---|---|---|---|
| 5,475,292 | A | 12/1995 | Nakanishi et al. |
| 7,452,273 | B2 | 11/2008 | Amaitis et al. |
| 2003/0060264 | A1 | 3/2003 | Chilton et al. |
| 2004/0248632 | A1 | 12/2004 | French et al. |

(Continued)

*Primary Examiner* — Allen Chan
(74) *Attorney, Agent, or Firm* — Gregory M. Howison

(57) ABSTRACT

A method of simulating a gaming tournament utilizing a plurality of electronic game machines in a quasi-tournament includes the steps of: a) receiving value from a plurality of human users of the electronic game machines, the received value corresponding to a plurality of wagering credits whereby each human user is provided with a plurality of wagering units enabling the human user to participate in the quasi-tournament by playing one or more games on one of the electronic game machines, b) initiating a machine-implemented game on each game machine used in the quasi-tournament, whereby a human user may play the game using the electronic game machine to participate in the quasi-tournament, c) receiving input from the human user via a user interface associated with the electronic game machine to play the machine-implemented game, d) determining an outcome for each machine-implemented game played by each of the plurality of human users using the electronic game machines, e) updating the number of wagering units held by each human user based upon each outcome determined in step d), f) repeating steps b)-e) for the duration of the tournament, g) comparing the number of wagering units won by each human user in the quasi-tournament and determining one or more winners of the quasi-tournament and h) providing value to the one or more winners of the quasi-tournament.

20 Claims, 4 Drawing Sheets

(56) References Cited

U.S. PATENT DOCUMENTS

| | | | |
|---|---|---|---|
| 2005/0181856 | A1 | 8/2005 | Cannon et al. |
| 2006/0211462 | A1 | 9/2006 | French et al. |
| 2006/0246983 | A1 | 11/2006 | Huard et al. |
| 2006/0258425 | A1 | 11/2006 | Edidin et al. |
| 2007/0066403 | A1 | 3/2007 | Conkwright |
| 2008/0003114 | A1 | 1/2008 | Levin et al. |
| 2009/0121149 | A1 | 5/2009 | Radovanov et al. |
| 2010/0284826 | A1 | 11/2010 | Reid et al. |
| 2011/0056028 | A1 | 3/2011 | Park |

| | BLUE | RED |
|---|---|---|
| CARDS | ♠A ♦K | ♣5 ♣4 |
| BETTING | BLIND BET | RAISE |
| | RAISE | CALL |
| TABLE | ♣A ♣K ♣2 ♠7 ♦7 | |
| BEST HAND | ♣A ♠A ♣K ♦K ♠7 | ♣A ♣K ♣5 ♣4 ♣2 |

| ENTRY FEE | PLACE | MULTIPLIER | AWARD - PERCENTAGE OF PRIZE POT | AWARD - $$* |
|---|---|---|---|---|
| $105.00 | 1st | 0.50 | 50% | $50,000.00 |
| | 2nd | 0.30 | 30% | $30,000.00 |
| | 3rd | 0.20 | 20% | $20,000.00 |

* ASSUME 1000 PARTICIPANTS - TOTAL PRIZE POT = $100,000.00

*FIG. 6*

| ENTRY FEE | PLACE | MULTIPLIER | AWARD - PERCENTAGE OF $100.00 PRIZE POT |
|---|---|---|---|
| $100.00 | 1st | 0.50 | 50% |
| | 2nd | 0.30 | 30% |
| | 3rd | 0.20 | 20% |
| | | | AWARD - PERCENTAGE OF $500.00 PRIZE POT |
| $500.00 | 1st | 0.50 | 50% |
| | 2nd | 0.30 | 30% |
| | 3rd | 0.20 | 20% |
| | | | AWARD - PERCENTAGE OF $1000.00 PRIZE POT |
| $1000.00 | 1st | 0.50 | 50% |
| | 2nd | 0.30 | 30% |
| | 3rd | 0.20 | 20% |

*FIG. 7*

CONTINUAL LIMIT HOLD'EM QUASI-TOURNAMENTS

CROSS-REFERENCE TO RELATED APPLICATIONS

This application is a continuation of U.S. patent application Ser. No. 14/269,923, filed May 5, 2014, entitled CONTINUAL LIMIT HOLD'EM QUASI-TOURNAMENTS, which is a continuation of U.S. patent application Ser. No. 12/855,582, filed Aug. 12, 2010, entitled CONTINUAL LIMIT HOLD'EM QUASI-TOURNAMENTS, issued on May 6, 2014, as U.S. Pat. No. 8,715,051, which claims benefit of U.S. Provisional Application No. 61/233,366, filed Aug. 12, 2009, entitled CONTINUAL LIMIT HOLD'EM QUASI-TOURNAMENTS, the specifications of which are incorporated herein by reference in their entirety.

TECHNICAL FIELD

The gaming system and method disclosed herein relate to game tournaments and in particular, to a quasi-tournament wherein a tournament between multiple human players playing casino type games against each other is simulated with a plurality of electronic game machines whereby winners of the quasi-tournament are determined based on the outcome of games played by individual players against the game machines.

BACKGROUND

As used herein, the term "slot machine" or "game machine" is used to refer to electronic game machines of the type used in casinos. Such machines are typically designed to accept value from a human player in exchange for playing a game of chance. The value may be in the form of cash, game tokens, game tickets, a credit card or stored value card. After receiving the value, the game is played and the machine may dispense a prize, i.e., a "payout" depending on the result of the game. However, current game machines, and in particular, poker-type machines are typically configured to allow a single player to play a heads-up game against a machine. Consequently, there exists a need for a machine-based system and method that simulates a live tournament implemented on a plurality of game machines that allows players to enter or quit the simulated tournament at the player's discretion within competitive guidelines and restraints. Such a machine-based system and method may enable individual players in the simulated tournament to control when they submit the results of their play in the simulated tournament. The machine-based system and method may further enable individual players who have left or quit the simulated tournament to re-enter the simulated tournament. Players may re-enter the quasi-tournament at different levels at their discretion.

SUMMARY

In one embodiment, a method of simulating a gaming tournament utilizes a plurality of electronic game machines in a quasi-tournament. An entry fee (value), for example currency, is received from a plurality of human users or participants whereupon each human user is provided with a plurality of wagering units enabling the human user to participate in the quasi-tournament by playing one or more games on one of the electronic game machines. A machine-implemented game is initiated on each game machine used in the quasi-tournament enabling human users or participants to play the game using the electronic game machine to participate in the quasi-tournament. Input is received from the human user via a user interface associated with the electronic game machine to play the machine-implemented game. An outcome is determined for each machine-implemented game played by each of the plurality of human users with the electronic game machines and the number of wagering units held by each human user is updated based upon each outcome. The number of wagering units won by each human user in the quasi-tournament is used to determine one or more winners of the quasi-tournament. Prize(s) (e.g., value) are provided to the winner(s) of the quasi-tournament.

In one embodiment, indicia representative of a game state are displayed on a display associated with each of the game machines. The machine-implemented game may be poker in which case the indicia comprises visual representations of playing cards.

In another variation, a system for simulating a gaming tournament utilizing a plurality of electronic game machines wherein a plurality of human each play a machine-implement game on an electronic game machine. The system may include a plurality of electronic game machines configured with a machine-implemented game(s) whereby a plurality of human users may play the game or games using the electronic game machines to participate in the quasi-tournament. In one embodiment, the electronic game machines may include (i) a display device for displaying indicia representative of a game state, (ii) means for receiving an input from the user in response to a display of indicia representing a game state; (iii) a storage device for storing a game algorithm and (iv) a processor operative with the storage device to implement the game algorithm and operative with the display device to display indicia representative of a game state and to receive input from a human user of the machine. The electronic game machines may also include means, such as a card reader or currency reader for receiving value from a user of the machine.

The system further includes a central processor connected to each of the electronic game machines. The central processor is operative to receive an input from each of the electronic game machines corresponding to the outcome of games played on the electronic game machines by the human users and to determine one or more winners of the quasi-tournament based upon the outcome of games played by the human users on the game machines The system may include a data interface between each of the electronic game machines and the central processor whereby the outcome of games played by human users of the game machines are transmitted to the central processor.

BRIEF DESCRIPTION OF THE DRAWINGS

For a more complete understanding, reference is now made to the following description taken in conjunction with the accompanying Drawings in which:

FIG. 6 is a table illustrating one possible method of calculating awards for winners of a quasi-tournament as described herein; and FIG. 7 is a table illustrating a second possible method of calculating awards for winners of a quasi-tournament as described herein.

DETAILED DESCRIPTION

Figures 1, 2:
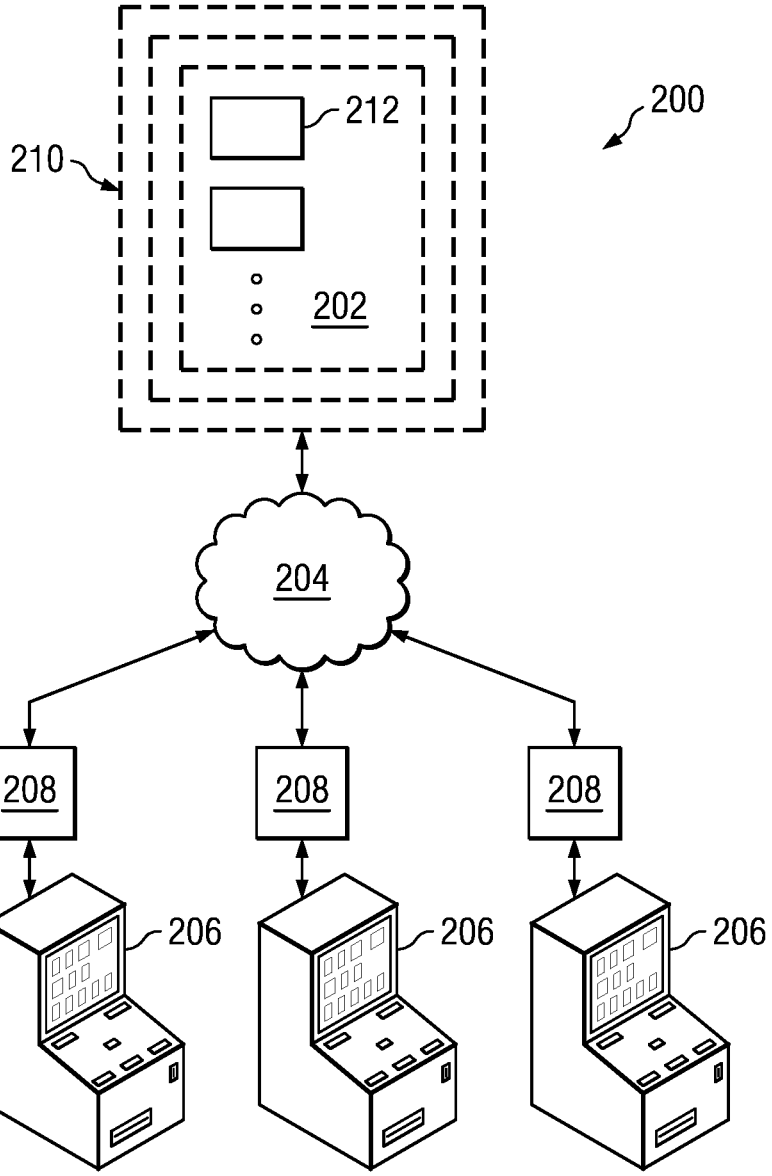
FIG. 1 illustrates a simplified game of Texas Hold'em poker.
FIG. 2 is a schematic representation of a gaming system suitable for use in a quasi-tournament, the system including a central office and a plurality of electronic game machines.

Referring now to the drawings, wherein like reference numbers are used herein to designate like elements throughout, the various views and embodiments of a system and method for implementing continual limit hold'em quasi-tournaments are illustrated and described, and other possible embodiments are described. The figures are not necessarily drawn to scale, and in some instances the drawings have been exaggerated and/or simplified in places for illustrative purposes only. One of ordinary skill in the art will appreciate the many possible applications and variations based on the following examples of possible embodiments.

Suitable games for implementation in connection with a machine-based gaming system and method adaptable for quasi-tournament play include poker as well as a variety of other games. The casino or game system operator is represented by an electronic game machine suitable for implementing and playing the game against the human player. As used herein, the term "quasi-tournament" refers to a simulated game tournament wherein a plurality of human players each play a machine-implemented "heads up" game such as poker against the casino or gaming system operator. The casino or game system operator is represented by an electronic game machine with the human winner(s) of the tournament determined on the basis of the success of the each human's play against the game machine.

Poker games suitable for a quasi-tournament format may include Hold'em poker, five and seven card stud, Razz (a low-ball game) and similar games. One variant of Hold'em poker is "Texas Hold'em," which is widely considered one of the most strategically complex variants. Texas Hold'em utilizes a standard 52-card deck and there are typically four betting rounds. In the first round, the players are dealt two private cards. Blind bets are used to start the first round. The first player (in the position of the "small blind") typically begins the hand with a set number of units in the pot and the second player (in the position of the "big blind") continues with a bet of 2× the set number units.

In the second round (or flop), three board cards are revealed. In each of the third round (turn) and fourth round (river), a single board card is revealed. A fixed-bet maximum may be used, with fixed raise amounts of X units in the first two rounds and Y units in the final two rounds.

A simplified example of a "head's up," (i.e., two player) Hold'em game suitable for adaptation as a machine implemented game may proceed as illustrated in FIG. 1. A full deck of 52 cards is shuffled (e.g. randomly arranged) and two private cards are dealt to each player (a human player and the machine). Private cards are revealed only to the player. The human player then makes a forced blind bet ("small blind") of one unit, whereafter the machine has the options of folding, calling and raising (by one unit). The betting process based on the private cards may continue until one player (the human or the machine) folds or calls. The number of raises may be limited to control the pot size and expedite the game.

A player loses the pot to the opponent if he folds. If the betting stops with a call, five open or common cards, called the table, are dealt. The common cards are revealed to and common to the players, so that the human and the game machine each have seven cards (two private cards and five common or public cards) from which they may choose their best five-card poker hand. The player that ends up with the better hand wins the pot. In the example illustrated in FIG. 1, the player designated as "Red" wins three units from the player designated "Blue," because the Red player's flush defeats the Blue player's two pair. Numerous variations and permutations of the game rules are possible.

To simulate tournament competition, multiple human players may each play against a casino or other game owner who is represented by a plurality of game machines. The results of each human player's play against a game machine determine the winner or winner(s) of the quasi-tournament. To enable a quasi-tournament, a casino or other gaming entity may install a number of electronic game machines, configured to play one or more selected games, for example, a Limit Hold'em poker. The casino may set external parameters for the machine-based quasi-tournament, including an official starting date and time, one or more entry fee(s) or level(s), the number of hands played by individual players and other parameters. In some variations, the entry fee, a portion of which may be used to fund a prize "pot" from which prizes are awarded to winning players, may be a fixed amount, for example $1000.00. In other variations, players may enter at different levels with different entry fees.

In other variations, the entry fees may be variable. For example, the casino or system owner may set minimum and maximum entry fees for example, $100.00 and $1,000.00. Tournament participants may enter for the maximum entry fee ($1000.00) or in increments equal to the minimum entry fee ($100.00). Different prize "pots" may be established based upon the entry fee selected by individual players. A single prize "pot" may be equal to the total amount of entry fees collected minus an administrative or other fee charged by the casino or owner of the gaming system. For purposes of determining the tournament winners, the number of starting small blind credits, (wagering units) must be equal; in other words, players may play enter at different levels and be eligible to participate in prize pots having differing values based on the entry fee for the pot, however, the players must begin on an equal basis in terms of wagering units. Thus, a player entering at a $1000.00 level would receive the same number of wagering units as a player entering at a $100.00 level but would be eligible to participate in different prize pots as hereinafter described.

In some variations, different prize pots may be established based upon differing entry fees. For example, a first prize pot may be established for players paying a $100.00 entry fee, a second prize pot may be established for players paying a $500.00 entry fee and a third prize pot may be created for players paying a $1000.00 entry fee. In this embodiment, players entering at the highest level ($1000.00) may participate in all the pots whereas participants entering at the lower levels will be eligible to participate in prize pots corresponding to the selected entry fee. Thus, a player entering at the $500.00 level would be eligible to participate only in the $100.00 and $500.00 prize pots and would not be eligible to participate in the $1000.00 prize pot. Numerous other variations are possible.

Exemplary tournament rules may be as follows:

A player will receive a fixed number wagering units upon payment of the entry fee. The player may use the credits or wagering units to play for as long as he or she wishes, or until the player exhausts their credit(s). The player may enter an unlimited number of times up to a predetermined cutoff date and time. Players may enter multiple times, and/or play simultaneous positions corresponding to each entry and at the completion of the tournament, or when the player withdraws from the tournament, the player may have a separate result for each entry.

Typically, the quasi-tournament continues for a predetermined time period, for example, one, three or five days. A player's participation in the tournament may, in one embodiment be limited to a fixed number of hands played for example 100, 300 or 500 hands. When the quasi-tournament is completed, the player who has accumulated the largest number of small blind credits or wagering units wins a first or grand prize as determined by the tournament rules. Lesser prizes may be awarded to players finishing in different positions, e.g., second, third, fourth place, on a sliding scale basis depending upon the rules of the particular tournament. Proportionately reduced prizes may be awarded based on entry fees less than the maximum entry fees. For example, all entrants may be eligible to receive a minimum amount depending on the entry fee selected. However, players who enter at higher levels may qualify for larger portions of the prize pot or amounts in segregated pots corresponding to increased entry fees.

In one variation, multiple casino (or other gaming enterprise) participation may be implemented. Multiple tournaments may be run concurrently. In one embodiment, a player may receive an entry identification card or slip for each entry. The identification card may be provided to the player at a casino or similar facility where the electronic game machines are located, by mail, or by means of a network, such as the internet. The gross size of the prize pot or pots may be displayed on the electronic game machines used in the quasi-tournament or other displays to encourage players to join the tournament. Alternatively, running scores for individual players may be kept confidential e.g., accessible only to the individual player so that late entrants will not know the current position of previous entrants, promoting a perception of fairness. In this regard, disclosure of an earlier entered player's randomly high position or score could tend to discourage potential players that may wish to join an ongoing tournament.

FIG. 2 is a block diagram illustrating a system 200 for implementing a quasi-tournament in a casino-style gaming environment. System 200 includes a plurality of game machines 206 operatively connected to a central office 210 including a dedicated quasi-tournament engine 202. Central office 210 may be located remote from game machines 206 and may control game machines located in multiple remote locations. A network 204, such as a wired Local Area Network (LAN) or a public or private wireless network may be used to route communications between central office 210, quasi-tournament engine 202 and game machines 206. A plurality of data interfaces 208 may be utilized for security purposes and to facilitate communications between game machines 206 and central office 210. In one variation, engine 202 may employ one or more Application Specific Integrated Circuits (ASICs) with specific instructions hard-wired or burned into non-volatile memory to implement the methods described herein. In some embodiments, engine 202 may include a combination of preprogrammed software along with hardware and firmware to implement the methods. In yet other embodiments, engine 202 may be programmable using a remote device. One or more physical security measures generally indicated at 212 may be employed to maintain the integrity of engine 202 and to prevent tampering. Such measures may include locating engine 202 in a locked room or enclosure, and/or using alarms, motion detectors, proximity sensors or similar devices to prevent unauthorized access to engine 202.

Referring still to FIG. 2, central office 210 may be connected to game machines 206 via a network 204 and device interfaces 208. Interfaces 208 include hardware and software adequate to enable communications between engine 202 and electronic game machines 206. Network 204 may be a hard-wired or wireless Local Area Network (LAN), a Wide Area Network (WAN) or the Internet. Transmissions between engine 202 and electronic game machines 206 may be encrypted using known techniques such as TSL or SSL protocols to prevent hacking or unauthorized access to the engine 202 and game machines 206. In this embodiment, game machines 206 may be located at the same or different locations. For example game machines 206 may be located at different casinos, or similar establishments, at geographical diverse locations and operatively connected to engine 202 via a network 204 as described above.

Figure 3:
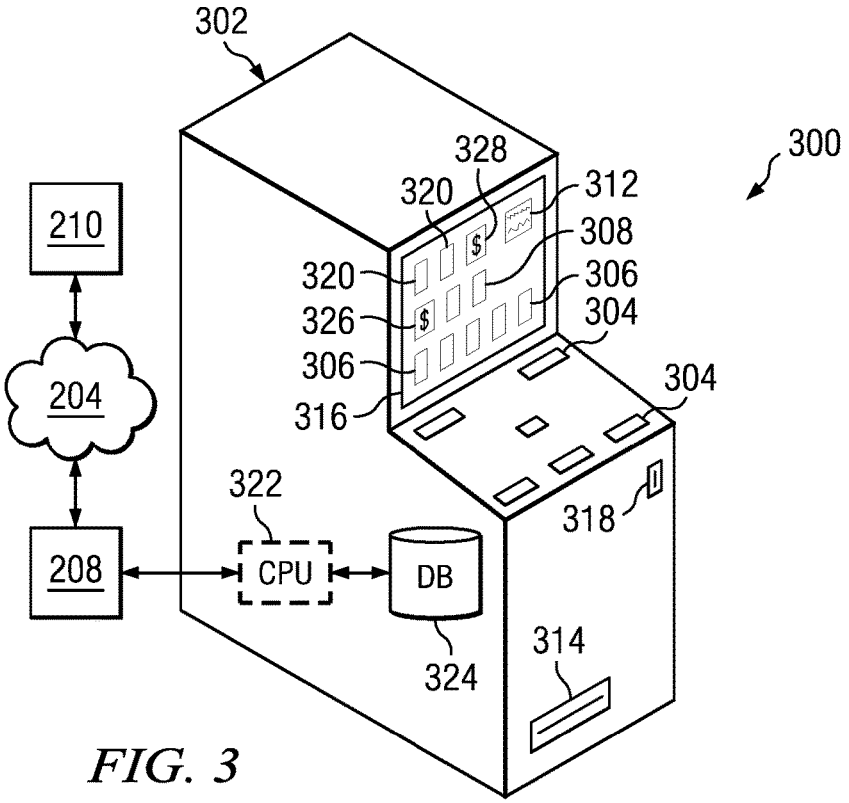
FIG. 3 illustrates an electronic game machine suitable for use in the system of FIG. 2.

Referring now to FIG. 3, there is illustrated a diagrammatic view of an electronic game machine 300, similar or identical to machine 206 of FIG. 2, suitable for use in a system and method for implementing a machine-based quasi-tournament. Machine 300 includes a chassis 302 for mounting a display 316 and one or more user interfaces 304 that allows a human user to interact with the system to participate in a quasi-tournament. User interfaces 304 may include features similar to a graphical touch screen, keyboard, buttons, levers, or switches that enable the user to play games using game machine 300. Display 316 may further comprise a graphical user interface, providing one or more additional user interfaces. User input will typically be based on a decision to take an action. In the case of a machine-implemented poker game, the action may be to place a bet, raise, call/check or fold.

A payment input device 314 allows a user to input a credit card, debit card, smart card, bar coded ticket or other stored value card or token to pay the entry fee for the quasi-tournament. Alternatively, payment input device 314 may be a currency reader. In one embodiment, machine 300 may include a cash, ticket or token dispenser 318 to make cash payments or dispense tokens or tickets to the user. In one embodiment, a stored value card is used to record and store a player's position, e.g. the number of wagering units available to the player in a quasi-tournament, thereby enabling a player to enter, leave and re-enter the tournament by removing or inserting the card into a machine 300. It is anticipated that a player will have a separate card, or at least separate account, for each distinct entry.

Display 316 provides a human player one interface with the electronic game machine, i.e., it displays an indicia representative of a game state, for example a simulation of the cards in play. By way of example, in accordance with a machine-implemented simplified heads up Texas Hold'em game as described in connection with FIG. 1, the display may show the human player's two private cards 308. The human user's private cards 308 will be displayed to the user, but the game itself has no access to the human's private cards. The game's private cards 320 will appear to the user on display 316 as if the cards were turned down, but electronic game machine 300 will have access to the information associated therewith. Community cards 306 will be displayed to the human user and will be known by machine 300. During play, the human player may select various actions, i.e., raise, fold, check or call, using user interface devices 304.

In one embodiment, a player's position, e.g., the number of small blind credits or wagering units available to the player may be presented on display 316. Additionally, the prize pot or pots 326 associated with a quasi-tournament may also be presented on display 316 to simulate interest the tournament. The player's position and the size of the prize pot or pots 326 may be continuously or periodically updated as the quasi-tournament progresses. Other information 312, for example the duration of the quasi-tournament and/or the remaining time or hands to be played in the tournament may also be displayed.

In one embodiment, game machine 300 has a dedicated processor 322 or "brain" along with an associated database 324 operatively connected to the processor. In this embodiment, game machine 300 is a stand-alone unit that may be monitored by central office 210 to monitor the player's results during the tournament and for audit and accounting purposes. Different machine-implemented games, suitable for a quasi-tournament may be down loaded from central office 210 to processor 322 and/or stored on database 324, enabling electronic game machine 300 to play selected games on a stand alone basis. In other variations, the operation of game machines 300 may be directly controlled by central office 210 during play.

Figure 4:
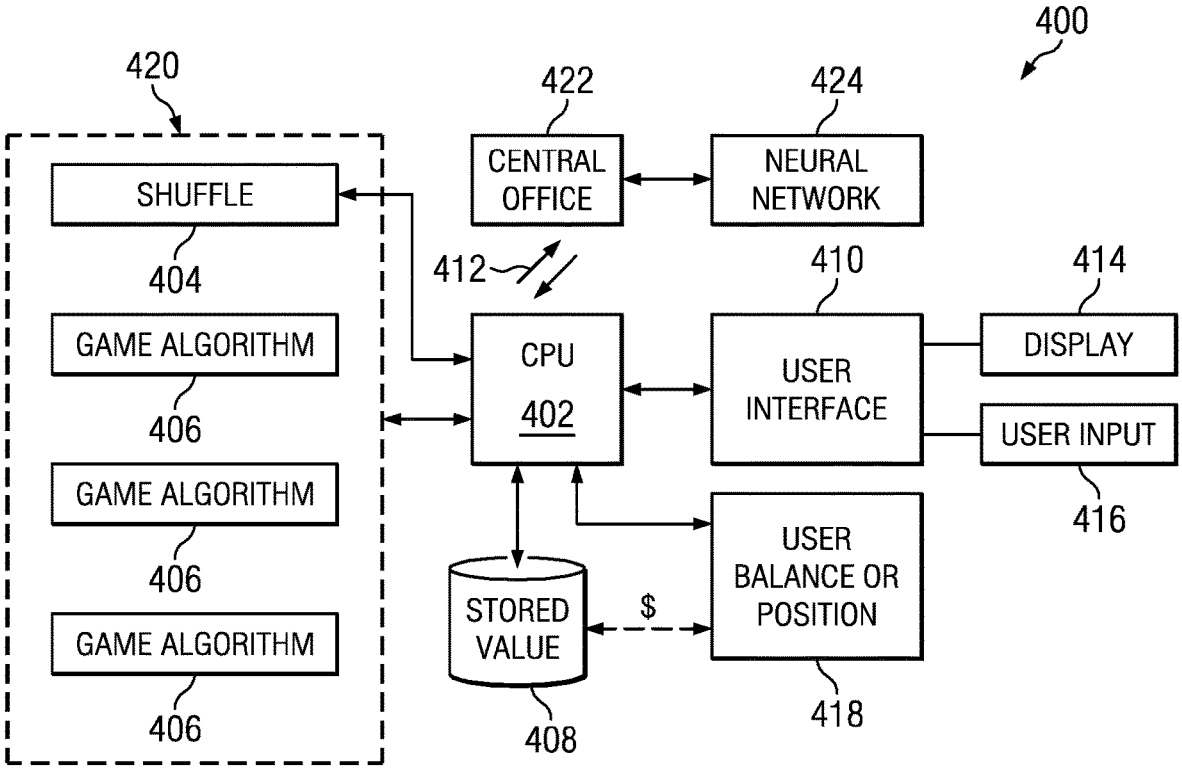
FIG. 4 is a block diagram illustrating one configuration of an electronic game machine suitable for use in the system of FIG. 2.

FIG. 4 is a block diagram schematically illustrating one configuration of an electronic game system 400 that may be implemented on a game machine such as machine 300 of FIG. 3. As illustrated, a plurality of algorithms such as a shuffle algorithm 404 and game algorithms 406, corresponding to different games and actions available on the machine, are stored on data base 420. Processor 402 may access the different algorithms 404, 406 in response to user input 416 received via user interface or interfaces 410 to take various actions. Such actions may be in response to an action by a human player during play.

Processor 402 may interface with a stored value module 408 such as a magnetic card read/write module for maintaining and updating the player's position 418 on a stored value card or similar device. This enables a player to leave the tournament by removing the stored value card and to resume play continuing the previous session by inserting the card in module 408. Once a player has submitted his result to the tournament administrator for a given entry, he may no longer continue that session, but may reenter by paying another fee. As a quasi-tournament progresses and a participant plays more hands, his or her position, i.e., the number of small blind credits or wagering units in the player's possession will increase or decrease depending on the outcome of the hands the participant plays against an electronic game machine. Processor 402 maintains a record of the player's position 418, debiting or crediting the number of small blind credits available to the player and storing the player's position on stored value module 408. Processor 402 may communicate the player's identity, the player's position, the identity and status of the game in play and other information to a central office unit 422, continuously or at periodic intervals, via a data interface represented by arrows 412. At the conclusion of the tournament, central office unit 422 compares the results, e.g., the number of small blind credits or wagering units accumulated by each participant, to determine one or more winners of the quasi-tournament.

In one embodiment, processor 402 is operable to execute a game algorithm 406 which plays a selected game, for example a hold'em poker game. In one variation, processor 402 interfaces with and uses one or more neural networks 424 along with a selected game algorithm 406. The output of neural networks 424 may be a probability distribution for certain actions, i.e., there are a number of actions associated with a neural network each of which have a probability distribution associated therewith. The neural networks may be "trained" to associate the probabilities of different outcomes based on particular game states. The probability distribution(s) may be used to determine actions that may be taken by system 400 during play, e.g. to fold, call/check or raise. Game algorithm(s) 406 may be designed to introduce a random component or factor in order to prevent predictable responses on the part of the game.

Referring still to FIG. 4, different games will also have associated therewith some type of "shuffle" algorithm or program 404 that will shuffle, i.e., randomly arrange the cards. Shuffle algorithm 404 may use a random or pseudo-random number generator to simulate a shuffle of a 52-card deck and select cards for the game. As previously noted, game algorithms 406 may rely on one or more neural networks 424 to enable system 400 to play the corresponding game.

Figure 5:
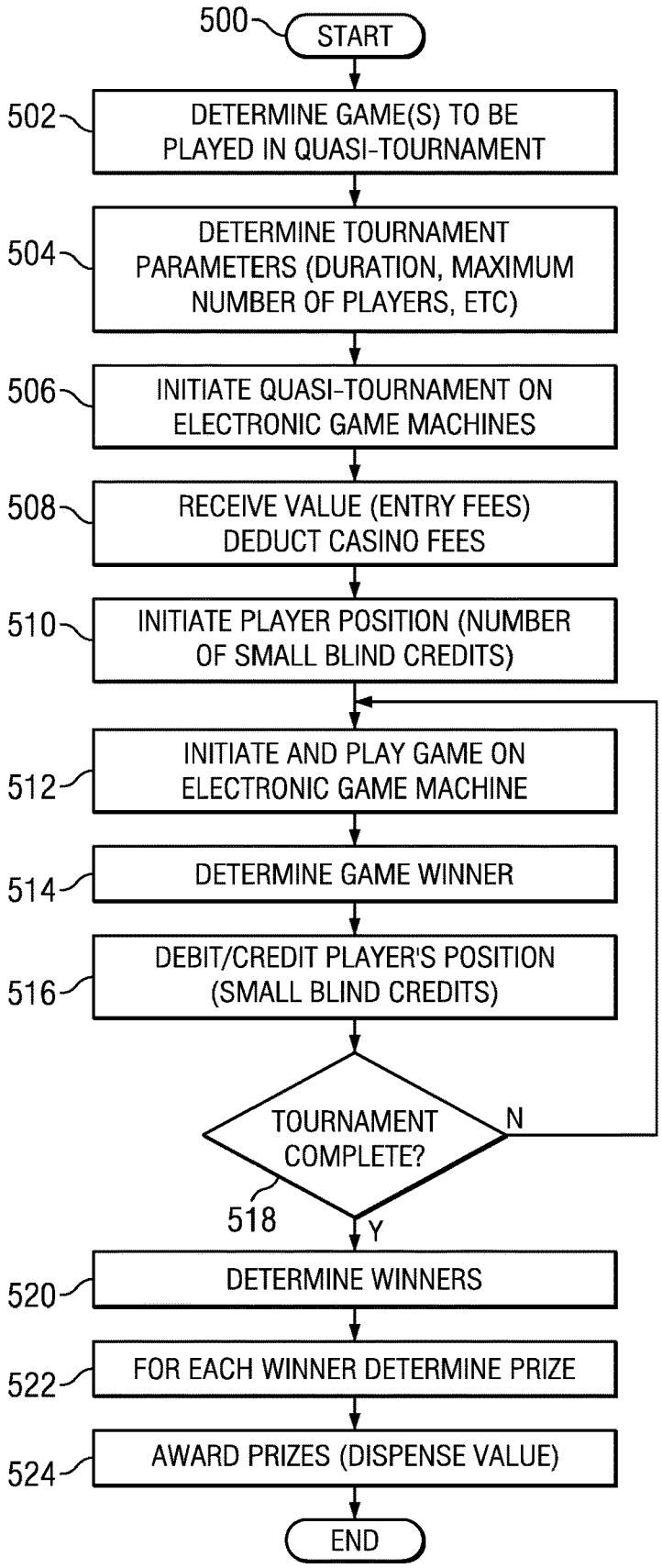
FIG. 5 is a flow chart of one method for conducting a quasi-tournament.

FIG. 5 is a flowchart illustrating a method of conducting a quasi-tournament in accordance with the disclosure. The method begins at step 500 and at step 502 the game or games(s) to be played in the tournament are determined. The number and type of electronic gaming machines to be used in the tournament may also be determined at this point. If necessary, electronic game machines to be used in the quasi-tournament may be provided at selected locations. In regard to the selection and configuration of electronic game machines for a quasi-tournament, it should be noted that multiple different games may be played by participants. In one variation, a participant may be required to play three different games, for example a hold'em game, five card stud and a low-ball game such as Razz during the course of the tournament. The player's results against the electronic game machine for the three different games may be combined to determine the player's position. Alternatively, the player may select his or her results in one of the three games to determine his or her position. In another embodiment, the quasi-tournament may accommodate team play. For example, the combined results of a team of three different players, each playing the same or different games, may determine the tournament winners.

At step 502 tournament parameters are determined. The parameters may include the length of the tournament in terms of time or total number of hands played, the number of game machines to be used in the quasi-tournament, the number of wagering units to be assigned to each player based upon the entry fee paid, minimum and maximum entry fees, participation in prize pots based on entry fees and other rules or constraints. At step 506, the quasi-tournament may be initiated on a selected number of electronic game machines 300 (FIG. 3). The process of initializing the tournament may include downloading and/or enabling the algorithms to play the game or games used in the quasi-tournament on the selected game machines 300, displaying an announcement of the tournament on the game machines and displaying the parameters and rules of the tournament on the game machine.

Participants may enter (or re-enter) the tournament at step 508 by paying an entry fee (value) which is received by the casino or system operator. As previously noted, in one embodiment, a participant may elect to enter the tournament at different levels corresponding to greater or lesser entry fees corresponding to different prize pots For example, a participant may elect an entry fee of $100.00, $500.00 or $1000.00. Participants electing to pay a $1000.00 entry fee may be eligible to participate in the prize pots corresponding to $100.00, $500.00 and $1000.00 entry fees whereas participants electing to pay the $100.00 entry fee would be eligible to participate only in the $100.00 prize pot.

In one embodiment, a participant may enter or re-enter the tournament by inserting a stored value card, cash or token(s) into game machine 300 (FIG. 3) to pay an entry fee. In other embodiments, a participant may purchase a dedicated tournament card from the casino for an amount equal to a selected entry fee plus an optional fee. The dedicated tournament card is inserted into machine 300 which updates the players' position, i.e., the number of wagering units available to the player, as the tournament progresses. The dedicated tournament card enables the play to leave and re-enter the tournament at his or her discretion using the same or different electronic game machine 300, or a different locations where the electronic game machines are located. For example, a player may elect to leave a tournament temporarily for a meal. The player removes his or her dedicated tournament card from the machine, has the meal and then returns to the same or different location and re-enters the tournament by inserting the card into the same or different electronic game machine 300. The period of time that a player may leave the tournament may be limited to, for example one or two hours, in order to prevent participants from leaving the quasi-tournament for excessive periods which may delay completion of the tournament. Regardless, failure to submit a result prior to the announced termination time of the tournament may result in forfeiture of possible prizes.

After the player has paid the entry fee and/or inserted his or her tournament card into electronic game machine 300, the player's position (available number of wagering units) is initiated on the machine and/or with central office 210 (FIG. 2). A game is initiated and played on machine 300 between the human player and the machine at step 512. The winner of the game or hand is determined at step 514 and the player's position is debited or credited at step 516 depending on the outcome of the game. Electronic game machine 300 may be configured or programmed to time out in the event that a player does not complete a game or hand within a predetermined time, for example, five or ten minutes. If the electronic game machine 300 times out, the player will lose (forfeit) the game or hand.

At decision block 518, the status of the quasi-tournament is tournament is checked. If the tournament is still in progress, the process loops back to step 512 and another hand is played. If the tournament is complete, i.e. the allotted time has expired, the tournament winners are determined at step 520. The prizes to be awarded to each winner are determined at step 522. The prizes are awarded (value dispensed to participant) at step 524 and the process ends at step 524.

FIG. 6 is a table illustrating one method of calculating awards for winners of a quasi-tournament as described herein. In this embodiment, the entry fee is fixed at $105.00, including a $5.00 administrative fee for the casino or game operator. Assuming 1000 participants, the total prize pot would be $100,000.00.

In the example, each participant receives 200 (or other selected number) wagering units upon payment of the entry fee. The tournament may extend over a predetermined time, for example, 1, 2 or 3 days. The winner is determined by who accumulates the most wagering units, or small blind credits. All competition is exclusively between each participant and an electronic game machine and the winner or winner(s) are determined based upon accumulated wagering units relative to accumulated units of other participants.

Participants may enter or re-enter the quasi-tournament at any time they wish, within the prescribed three-day period, and leave the quasi-tournament at any time they wish. They can play for a period, take a break, go to a movie, etc., and then resume playing—until the termination time or the tournament. During the tournament, participants may go "bust," e.g. lose all of their wagering units and then re-enter an unlimited number of times. Participants may enter several times and submit multiple results. Of course, results of multiple entries are not additive, but totally separate, as if a different person entered each time.

A participant's result becomes official when he submits it to the tournament administrator. For example, a participant may accumulate 1000 or 1500 wagering units and decide to cease play, in which case the participant's position at the end of the tournament will be 1000 or 1500 wagering units. When the tournament terminates, the participant who has accumulated the greatest number of small blinds credits or wagering units is declared the winner, with the participant who has accumulated the second largest number of wagering units is awarded second place, etc.

Assuming that three places, first, second and third are awarded prizes. In this example, the first place is awarded 50% (0.50 multiplier) of the prize pot, the second place is awarded or 30% or the prize pot and the third place is awarded 20% of the prize pot. Consequently, the winner would collect 50% of the total entry fees, or $50,000. The second place finisher would be awarded $30,000 with the participant finishing in third place receiving $20,000.

FIG. 7 is a table illustrating an alternate method of calculating awards for winners of a quasi-tournament as described herein. In this example, participants may enter the quasi-tournament at different levels by paying differing entry fees. Awards or prizes are based upon the entry fee paid by winning participants as well as the outcome of the games or hands played by the participant as reflected by the number of wagering units accumulated by the participants. Accordingly, different prize pots are set up according to the entry fee paid by participants. In this example, participants may enter at a $100.00 level, a $500.00 level and a $1000.00 level. For simplicity, the casino or game operator fees are omitted; however, such fees may be added onto the entry fee. Thus, if the game operator's fee is 5%, the total fees would be $105.00, a $525.00 level and a $1050.00, respectively.

In this example, the entry fees are segregated into three prize pots. The first prize pot includes $100.00 for each participant in the quasi-tournament since $100.00 is the minimum entry fee. The second prize pot includes $400.00 ($500.00-$100.00) for each participant entering at the $500.00 level and the third prize pot includes $500.00 ($1000.00-$500.00) for participants entering at the $1000.00 level. Participants that pay the $1000.00 entry fee are eligible to participate in all three prize pots, participants entering at the $500.00 level are eligible to participate in the first ($100.00) and second ($500.00) prize pots and those participants entering at the minimum level are eligible to participate only in the first, $100.00 prize pot.

According to the example, three winners are determined for each prize pot with the first place winner receiving 50% of the pot, the second place winner receiving 30% of the pot and the third place winner receiving 20% of the pot. Since the winners participating in each of the three prize pots are determined separately based upon the entry fee paid by the participant, a participant could finish in different positions with respect to each of the prize pots. For example, a participant entering at the $1000.00 level could finish in third place with respect to the first prize pot, second place with respect to the second prize pot and first place with respect to the third prize pot. In this case, the participant's award would be the sum of 20% of the first prize pot, 30% of the second prize pot and 50% of the third prize pot. Alternatively, if the same participant had entered at the $500.00 level, corresponding to the second prize pot, he or she would receive the sum of 20% of the first prize pot, and 30% of the second prize pot since he or she would not be eligible to participate in the third prize pot. If the same participant had entered at the $100.00 level, he or she would receive only 20% of the first prize pot since he or she would not be eligible to participate in the second and third prize pot.

The foregoing format for a machine-based quasi-tournament tournament may provide a casino owner an alternative to internet-based poker tournaments which have enjoyed considerable success. Advantages to a machine-based casino poker tournament may include integrity, elimination or reduction of player collusion, and the elimination of structured starting and ending time constraints for the participants. The amount of funds the casino or game system owner holds includes entry fees with buy-in units available to effectively utilize the number of game machines available and the physical space occupied by the machines. As entry fees and/or buy-in units accumulate, real-time notification of the size of the prize pool will serve to create interest, excitement and increased participation on the part of players and prospective players.

The quasi-tournament format offers players the chance for a large payoff with pre-defined risk. In the case of tournaments having a large number of players, the eventual winner or winners may accumulate large numbers if credits and correspondingly large prizes that can lead significant positive publicity for the quasi-tournament format. Such positive publicity will tend to encourage participation; increase the excitement associated with casino play and provides the casino or game system operator with additional options for attracting players.

It will be appreciated by those skilled in the art having the benefit of this disclosure that the system and method for continual limit hold'em quasi-tournaments described herein simulates a live tournament implemented on a plurality of game machines that allows players to enter or quit the simulated tournament at the player's discretion within competitive guidelines and restraints. It should be understood that the drawings and detailed description herein are to be regarded in an illustrative rather than a restrictive manner, and are not intended to be limiting to the particular forms and examples disclosed. On the contrary, included are any further modifications, changes, rearrangements, substitutions, alternatives, design choices, and embodiments apparent to those of ordinary skill in the art, without departing from the spirit and scope hereof, as defined by the following claims. Thus, it is intended that the following claims be interpreted to embrace all such further modifications, changes, rearrangements, substitutions, alternatives, design choices, and embodiments.

What is claimed is:

1. A system for simulating a gaming tournament with a quasi-tournament, the system including:

a plurality of electronic game machines configured with a machine-implemented game whereby a plurality of human users play the machine-implemented game using the electronic game machines and wager using wagering units to participate in the quasi-tournament, wherein the system is operative to enable a human user entering the quasi-tournament to provide differing amounts of value a single time as an entry fee, the differing amounts of value corresponding to prize pots of differing value whereby the human user is eligible to receive a payout from multiple prize pots at a conclusion of the quasi-tournament;

a central processor connected to each of the electronic game machines, the central processor operative to receive an input from each of the electronic game machines corresponding to an outcome of games played on the electronic game machines by the human users, to determine one or more winners of the quasi-tournament based upon the outcome of games played by the human users on the electronic game machines, wherein the human users may select, as input, after the machine-implemented game is initiated and value received from the human user, from one of at least two different potentially winning actions at a single stage in each game played by the human users; and wherein the system is operative to provide the human user winning the quasi-tournament with a payout from one or more prize pots upon winning the quasi-tournament.

2. The system of claim 1, wherein each of the electronic game machines includes (i) a display device for displaying indicia representative of a game state, (ii) a means for receiving an input from the human user in response to a display of indicia representing the game state, and (iii) a magnetic card reader.

3. The system of claim 2, wherein the electronic game machines include:

a storage device for storing a game algorithm; and, a processor operative with the storage device to implement the game algorithm and operative with the display device to display the indicia representative of the game state and to receive the input from the human user of an electronic game machine of the at least two different potentially winning actions.

4. The system of claim 2, wherein the displayed indicia are visual representations of playing cards.

5. The system of claim 2, wherein the magnetic card reader comprises a stored value card reader whereby value may be transferred from and to a stored value card by an electronic game machine.

6. The system of claim 2, wherein the central processor is further operative to interface with the magnetic card reader to maintain and update a player position for a magnetic card associated with a player.

7. The system of claim 6, wherein the central processor is further operative to:

allowing a player to withdraw by removing the magnetic card from the magnetic card reader, and allowing a player to reenter, according to the maintained and updated player position, by reinserting the magnetic card into the magnetic card reader.

8. The system of claim 1, wherein the machine-implemented game is poker.

9. The system of claim 1, further comprising a data interface between each of the electronic game machines and the central processor whereby the outcome of games played by the plurality of human users of the electronic game machines are transmitted to the central processor.

10. The system of claim 1, wherein each of the electronic game machines further comprises means for receiving value from a user of an electronic game machine.

11. The system of claim 1, wherein the system is operative to enable the human user to enter the quasi-tournament after the quasi-tournament begins by providing value to enter the quasi-tournament.

12. The system of claim 1, wherein each human user entering the quasi-tournament is provided with a same number of wagering units independent of the amount of value provided by the human user.

13. A method of simulating a gaming tournament utilizing a plurality of electronic game machines in a quasi-tournament, the method comprising:

a) receiving a selected value in a form of an entry fee from human users, wherein the human users entering the quasi-tournament provide differing amounts of value a single time as the entry fee, the differing amounts of value corresponding to prize pots of differing value whereby the human users are eligible to receive a payout from multiple prize pots in the quasi-tournament at a conclusion of the quasi-tournament;

b) initiating a machine-implemented game on a plurality of the electronic game machines, wherein the electronic game machines are connected with a data interface to a central processor, whereby the human users participate in the quasi-tournament by playing games on the electronic game machines;

c) displaying indicia to the human users with an electronic display associated with the electronic game machines, the indicia representative of a game state and prompting input by the human users in response to the game states, wherein a human user may select, as input, one of at least two different potentially winning actions at a single stage in each game played by the human user;

d) receiving inputs selected by the human users with the electronic game machines and determining outcomes of games played by the human users of the electronic game machines;

e) automatically transmitting from the electronic game machines to the central processor the outcomes of games played by the human users of the electronic game machines; and f) comparing, with the central processor, the outcomes of the games played by the human users of the electronic game machines to determine one or more winners of the quasi-tournament.

14. The method of claim 13, wherein the electronic game machines include:

a storage device for storing a game algorithm; and a processor operative with the storage device to implement the game algorithm and operative with the electronic display to display indicia representative of the game state; and the method further comprising receiving input from the human user of an electronic game machine and executing the game algorithm with the processor to determine a response to the input of the human user.

15. The method of claim 14, further comprising changing the displayed indicia to show the response to the input of the human user whereby the game state is changed.

16. The method of claim 13, wherein the machine-implemented game is poker.

17. The method of claim 13, wherein the displayed indicia are visual representations of playing cards.

18. The method of claim 13, wherein each human user receives a same number of wagering units independent of value received.

19. The method of claim 13, further comprising interfacing a magnetic card reader with the central processor to maintain and update a player position for a magnetic card associated with a player.

20. The method of claim 19, further comprising:

allowing a player to withdraw by removing the magnetic card from the magnetic card reader; and allowing a player to reenter, according to the maintained and updated player position, by reinserting the magnetic card into the magnetic card reader.

* * * * *